United States Patent [19]

Bertoli et al.

[11] Patent Number: 4,539,802

[45] Date of Patent: Sep. 10, 1985

[54] PROCEDURE TO SPLICE YARNS

[75] Inventors: Luciano Bertoli, Salo' ; Roberto Badiali; Claudio Speranzin, both of Pordenone, all of Italy

[73] Assignee: Officine Savio S.p.A., Pordenone, Italy

[21] Appl. No.: 592,549

[22] Filed: Mar. 23, 1984

[30] Foreign Application Priority Data

Mar. 28, 1983 [IT] Italy ..... 83358 A/83

[51] Int. Cl.[3] ..... B65H 69/06; D01H 15/00

[52] U.S. Cl. ..... 57/22; 57/202; 57/261

[58] Field of Search ..... 57/22, 261, 202

[56] References Cited

U.S. PATENT DOCUMENTS

| | | | |
|---|---|---|---|
| 4,170,103 | 10/1979 | Norris et al. | 57/22 X |
| 4,341,066 | 7/1982 | Baumgartner | 57/22 |
| 4,386,494 | 6/1983 | Felix | 57/22 |
| 4,407,117 | 10/1983 | Garnsworthy | 57/22 |

*Primary Examiner*—Donald Watkins

*Attorney, Agent, or Firm*—Wegner & Bretschneider

[57] ABSTRACT

This invention concerns improvements to procedures to splice yarns (20–21), whether textile yarns or otherwise, the splice being obtained by coupling two single untwisted yarns (20–21) and by reconstituting the twists thereafter, by which improvements a part of the single yarns (20–21) is untwisted until twists of a sign opposite to the sign of the original twists have been imparted, such part then being coupled and reduced tails (220–221) of yarns being obtained, the coupled tract then being retwisted until a required twist has been imparted, the improvements envisaging that the reduced tails (220–221) are obtained after the fibers to be plucked and/or torn (42) have been made substantially parallel and after a substantially axial plucking and/or tearing action has been applied to such fibers (42), and that the taper (320–321) of the remaining reduced tails (220–221) reaches the neighborhood of the periphery of retwister rings (28), the resulting remaining tails (220–221) being controlled and positioned beside the yarns (20–21) before the action to impart the required retwisting is begun.

21 Claims, 12 Drawing Figures

PROCEDURE TO SPLICE YARNS

This invention concerns a procedure to splice yarns, whether textile yarns or otherwise. To be more exact, the invention concerns an improved procedure to splice yarns, whether textile or otherwise.

The invention also concerns splices obtained with the improvements of this invention and also the yarns which include such splices.

Splices of textile yarns made with fisherman's knots or weaver's knots or other types of knots are known.

Splices are also known which are made between yarns by means of adhesives or joints obtained by winding threads or an outer ribbon or fibres of the yarns themselves.

Splicers are known, moreover, which are obtained by entangling and matting the fibres of two yarns by blowing air or by means of electrostatic fields.

The splices obtained with such procedures entail shortcomings as regards their dynamometric characteristics or as regards the ability to employ the spliced yarn in the successive usage means or as regards the general characteristics of the splice.

Splices are also known which are obtained by untwisting single yarns, uniting them and then retwisting together the yarns to be spliced in their tract to be spliced.

A feature of such splices is the coupling of two yarns, which are then retwisted together, the yarns having been brought to a condition of almost parallel fibres before they are coupled.

Such splices have unsatisfactory mechanical properties since the fibres of the original yarns do not cooperate with each other except to a limited extent and in an inadequate manner. This entails unsatisfactory strength, inability to repeat such splices adequately, imperfect end zones and inadequate strength of the splice over a period of time.

Attempts have been made to improve these splices by disassembling and distributing the fibres, when the latter are substantially parallel, by means of mechanical and/or pneumtic devices, but appreciable results of a satisfactory level have not been obtained.

Knotters working with a jet or jets of air, for instance, concentrate the fibres by matting them together and stiffen the spliced tract, with a resulting loss of elasticity and with considerable problems for successive usage means, especially as regards dyeing and warping operations and other later operations.

The present applicant has perfected in the past an invention which has the purpose of obtaining a splice between yarns, whether textile or otherwise, which not only has excellent aesthetic features but also possesses mechanical and technological properties and characteristics of elasticity and of ability to be reproduced and of long life which have never been attained before.

Such invention is applicable either to equal yarns or to the coupling of yarns which are different from each other within a given value.

The procedure perfected by the present applicant envisages a procedure to splice yarns, whether textile or otherwise, the splice being obtained by coupling two single untwisted yarns, which are then retwisted; in that procedure the single yarns are untwisted beyond a substantially zero value of twist and are coupled together and are then retwisted until a desired twist at least almost the same as the twist in the original yarn has been imparted to the single yarns.

In that procedure the untwisting step is carried on beyond a zero value of twist until a negative twist has been imparted which is equal to at least 15–20% of the original twist of the single yarn, the value of the negative twist applied being at least in relation to the desired reciprocal thrust induced between the yarns, at least during the transient phase while the fibres are parallel to the axis of the single yarns coupled together during retwisting.

That procedure perfected by the present applicant has been found to be satisfactory either in the case of natural fibres or fibres which can be linkened to natural fibres or in the case of manmade or synthetic fibres.

However, the present applicant deems that the standard of the quality of the splice and the ability to reproduce the same are not such as to obtain the required morphological or technical and technological disguising of the splice within the remainder of the yarn.

So as to obtain a universal mechanical procedure to splice threads and yarns which is able to make splices differing in now way from the remainder of the yarn, the present applicant has studied, tested and perfected the following improvements.

With the procedure perfected earlier by the applicant the tapering of the tail ends was not controlled perfectly, the plucking and tearing action did not produce the required results and the tracts forming the splice were found not to have the required properties and dimensions.

For these reasons and yet others, as will be seen in the description which follows, the present invention sets forth improvements which have the purposes of controlling and balancing exactly the twists in the tract to be plucked and torn, of obtaining a plucking and tearing action with the characteristics required to obtain a perfectly controlled tapering of the tail ends, and of characterizing and controlling the tracts forming the splice.

The invention therefore proposes to obtain splices which are not only homogeneous but are also suitable for meeting the requirements of varied usage means thereafter, including more sophisticated usage means.

In fact, it is now possible to individualise such splices to suit the type of yarn and/or usage means, so that the splices have lengthwise transition sections and intermediate sections of a selected and perfectly controlled type and form.

It is also a purpose of the invention to provide a procedure suitable for obtaining splices of the type indicated above.

The known procedure envisages that two single yarns are untwisted until a negative twist of at least 15–20% of the initial positive twist has been produced in them, but such negative twist may even reach 100% or more of the initial positive twist.

The minimum negative twist, however, depends on the characteristics of the yarn and on how the yarn reacts in a mechanical splice procedure and also on the length of the splice.

So as to get our ideas clear, let us suppose that the yarns have a Z twist initially and that the splicing operation takes place with a device having disks and rings as perfected by the applicant and already protected by the same with proper patent applications now accessible to third parties.

When referring below to a device of this type, we shall speak of "untwister rings" or "retwister rings"

according to the steps included in the procedure of the invention and shall mean that such may be envisaged as being separate means for the untwisting and retwisting functions respectively or else may be the same means employed for the untwisting as well as for retwisting.

When no confusion is generated, in the latter step the retwister rings will also be comprised, for the sake of simplicity, among the retwister means, which shall be understood in that event as being the overall whole of the means cooperating to retwist the two yarns.

After the untwisting operation both of the yarns comprise in a determined tract an S type twist and the number of twists imparted per unit of length will be variable in relation to a plurality of factors.

The yarns are then clamped in a coordinated manner and are coupled so as to be in contact with each other advantageously on a generating line along a tract of a fixed and suitable length.

When the yarns have been coupled, the required tail ends are torn and plucked so as to obtain progressively tapered remaining tails.

Steps are then taken to apply to the coupled yarns a retwisting action that tends to impart to the coupled yarns at least the same twists as those initially present in the single yarns.

An action of progressive twisting is applied to the coupled yarns until a number of positive twists about the same as that of the twists imparted to the single yarns has been imparted to the coupled portion.

Thus far we have the known procedure which the present applicant has now improved and which is the subject of this invention.

According to the invention, which is always described and shown by reference to a device with disks and rings as an example, two yarns are placed parallel or crossed over each other in a median position in relation to retwister means.

Coupling means are present within the periphery of such retwister means, so that on each facing retwister means there is located a pair of coupling means, one pair being alternate to the other pair and alternate to the yarns.

If the two retwister means are caused to rotate in opposite directions to each other and the two yarns are interposed between them, then the yarns are untwisted to the required value.

At the end of untwisting the yarns ar placed beside each other along common tracts determined by the distance of the coupling means from each other.

Thus if the yarns have a Z twist initially, they will have at the end of untwisting an S twist or twist of about zero, and this twist will cover a length of yarn substantially the same as the distance between the peripheries in question of the retwister means and retwister rings.

It is a feature of the invention that at this point the yarns are placed substantially coupled together along a tract within the retwister means and are substantially detached from each other in their remaining portions.

When the yarns have been untwisted, the tracts outside the device and continuing in the two portions of yarn which are not torn are clamped by outer clamping means so as to retain the twists imparted so far; such clamping is applied near the retwister rings.

The tail ends too are clamped by twist-balancing grippers at a position farther out than the retwister rings.

In the zone at the end of the coupled tract of the yarns provision is also made to insert inner clamping means which lock the yarns at that position.

The distance of the clamping means in relation to the centre of rotation of the retwister means determines the length of the two tracts of yarn which are not plucked and are coupled together.

The sequence of such clamping actions can be varied to suit requirements.

When such clamping has taken place, the retwister rings, and possibly the retwister means too, withdraw from each other slightly.

This withdrawal has the effect that in the tail ends the S twist present in the tract comprised within the periphery of the retwister rings and positioned between the inner clamping means and such periphery is substantially cancelled with the Z twist present in the tract comprised between the periphery of the retwister rings and the twist-balancing grippers.

In this way only one tract of the tail ends is present substantially with its fibres parallel.

So as to improve this parallelism and to eliminate any hysteresis in the fibres, the twist-balancing grippers move slightly to tension such tract of the tail ends with a required value.

Plucking (and/or tearing) grippers then act on the tail ends with the fibres substantially parallel and take action near the edge of the retwister rings and grip the tail ends to be plucked.

After such gripping action the twist-balancing grippers open and leave the tail ends engaged by the plucking and/or tearing grippers alone, which pluck the fibres axially and create plucked remaining tails that start substantially at about the inside of the retwister rings.

Such remaining tails are well formed with substantially parallel fibres and a suitable shape that becomes progressively narrower from the point where the inner clamping means act, towards the periphery of the retwister rings, the remaining tails reaching substantially the neighbourhood of such periphery.

The plucked tail ends, which no longer take part in the splices, are discharged.

The remaining tails obtained in this way are controlled laterally by comb means, which determine the space for their sideways displacement in cooperation with the retwister means and retwister rings.

When the remaining tails have been obtained, the comb means bring such tails near to the yarns and keep the whole in contact.

The retwister rings and retwister means now close, whereas the comb means can now retreat.

The two yarns together with their common end tracts are now perfectly controlled by the retwister means and by the retwister rings, which during the retwisting rotate in the opposite direction to the direction of rotation of the eariler step of the untwisting of the yarns.

When the device is opened, the splice is perfect without tails or loose filaments and is impeccable technologically.

The invention therefore consists of improvements to procedures to splice yarns, whether textile yarns or otherwise, the splice being obtained by coupling two single untwisted yarns together and by reconstituting the twists thereafter, by which improvements the single yarns are untwisted until twists of a sign opposite to the sign of the original twists have been imparted, the single yarns then being coupled and retwisted until a required twist has been imparted to the single yarns, the improvements being characterized by the fact that, after fibres to be plucked and/or torn have been made substantially parallel and have been plucked and/or torn substantially axially, remaining tails are obtained with a taper reaching the neighbourhood of the periphery of retwister rings and are controlled and positioned beside the yarns before the action to impart the required retwisting is begun.

The invention is also embodied with a splice between yarns, whether textile yarns or otherwise, which is obtained with the above improvements.

The invention is further embodied with yarns, whether textile yarns or otherwise, which contain splices of the above type.

Let us now see a preferred embodiment of the invention with the help of the attached figures, which are given as a non-restrictive example and in which:

FIG. 1 shows a splice according to the invention;

FIGS. *2a* and *2b* shows the yarns positioned parallel within the retwister means in this example;

Figure 10A:
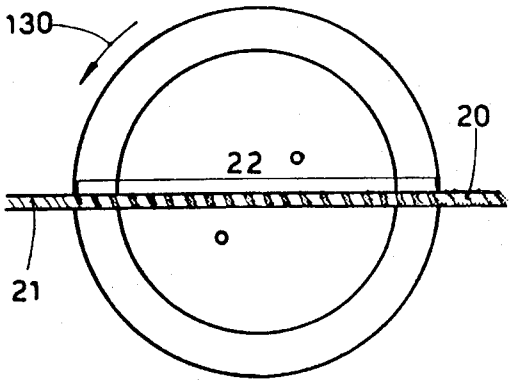
Figure 10B:
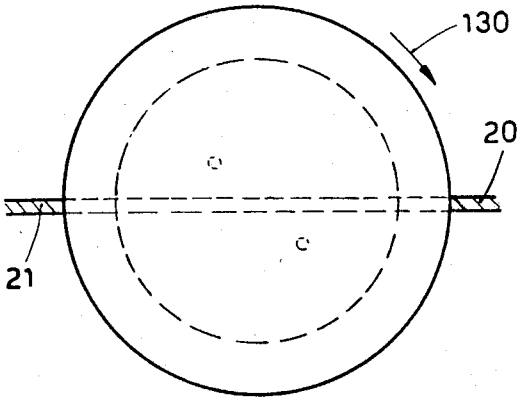

FIG. 10*a* and 10*b* show the retwisting of the prepared yarns and the obtaining of the splices.

Figures 1, 2A, 2B, 3:
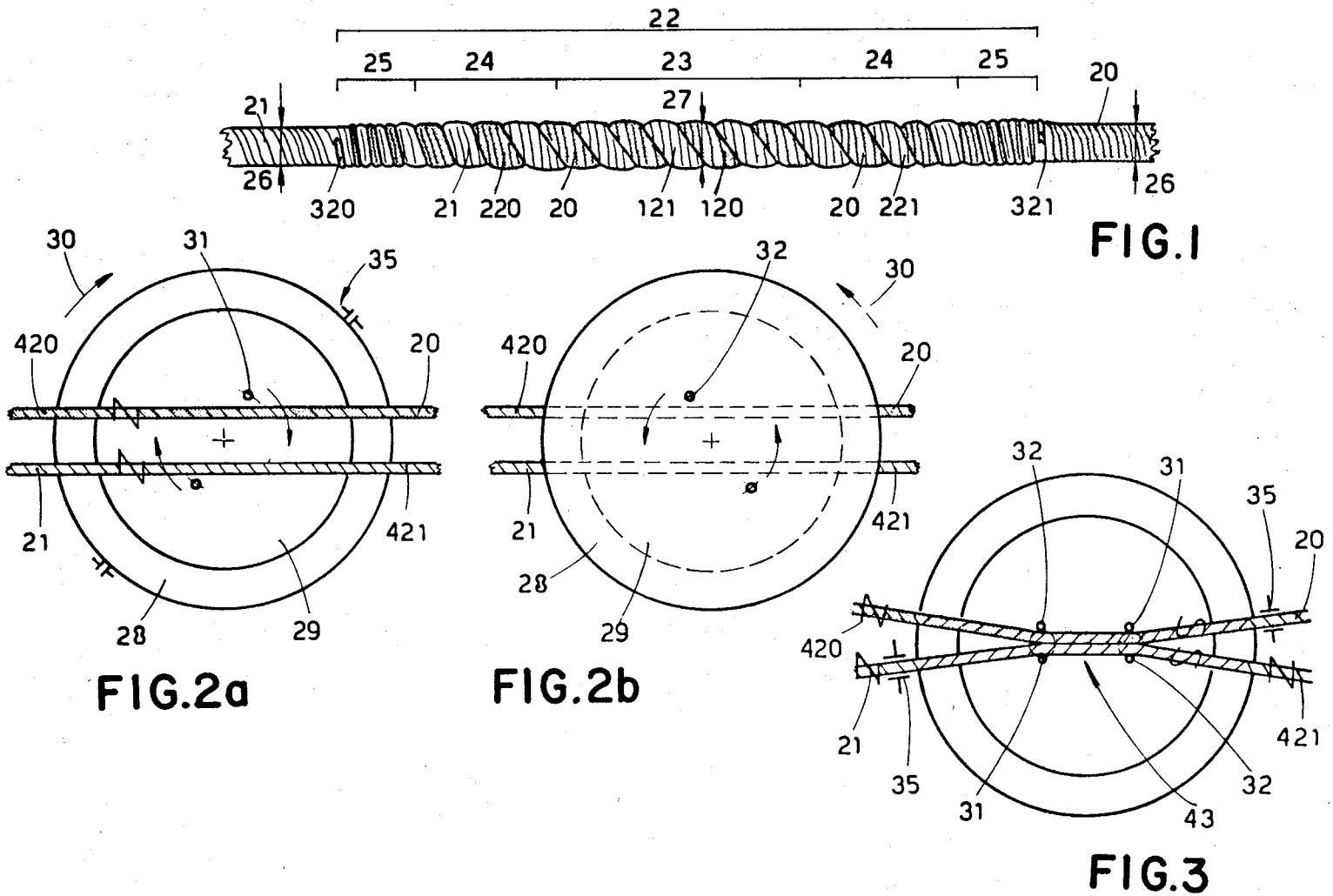
FIG. 3 shows the untwisting action completed.

In the figures FIG. 1 shows a splice 22 according to the invention made between two yarns 20 and 21 respectively, which in this case have the same characteristics. The invention can also be applied to splices made between yarns having different characteristics.

The splice 22 has a middle tract 23 in which the two yarns 20–21 have tracts 120 and 121 with an integral body 43; that it to say, in the tract 23 of the splice made with integral yarns the yarns 20-21 comprise a union made between two tracts of yarn with an integral body 43, in which the tracts 120-121 of yarns corresponding to the tract 43 are not tapered but have the same structure as the yarns 20-21 respectively.

At the sides of the tract 23 there are two tracts 24 of a splice between a yarn and a remaining tail respectively in which the yarns 20-21 are spliced with remaining tails 221-220 respectively.

At the ends of the splice 22 there are end tracts 25 of the splice in which the yarns 20-21 are spliced with end parts 321-320 of the remaining tails 221-220 respectively.

The end tracts 25 have a characteristic different from the tracts 24 in that the end parts 320-321 of the remaining tails 220-221 are wound so as to bond the yarns 21-20 respectively.

Let use see below how the foregoing parts are obtained. In the splice 22 made with the proposed improvements the tracts 24-25 are well bonded together without loose filaments or free fibres apart from the usual hairiness of a yarn and have a regular reduction of section.

The middle tract 23 of the splice 22 is also very compact and stable and has a density which decreases towards its ends, thus providing the splice 22 with considerable elasticity and ability to absorb tensions and tearing actions without being impaired.

Moreover, the bond caused by the zones 25 creates a very stable transition zone which cannot be detected with normal means nor in the most exacting normal textile processes.

Furthermore, a splice 22 made according to the procedure can have either a section 27 of splice 22 smaller (more compacted) than the section 26 of the yarns 20-21 or a substantially equal section or a section of its middle tract 23 which is thicker and decreases towards the ends.

The improved procedure of the invention envisages that the yarns 20-21 are positioned between two opposed retwister means 29. The yarns 20-21 can be positioned parallel or crossed over each other at about the axis of rotation of the retwister means 29.

The retwister means 29 cooperate with retwister rings 28, and the means 29 and rings 28 can have any surface conformation, such conformation being irrelevant for the purposes of this discription.

The retwister means 29 rotate, for example, according to the arrow 30 in the untwisting step (FIG. 2), whereas they rotate according to the arrow 130 during the retwisting step (FIG. 10).

As an example, let us assume that yarns 20-21 are being processed which normally contain a Z twist, but it is also possible to process yarns having S twists or false twists.

As a further example, the device shown with diagrams to illustrate the improved procedure comprises, within the retwister means 29 and in a required position, two coupling means 31 on one retwister means 29 and two coupling means 32 on the opposed retwister means 29. These coupling means 31-32 are positioned alternately and offset, as shown in FIGS. 2.

The coupling means 31-32 are shown as being immovable on the retwister means 29 but can be able to move axially and/or sideways and to perform other functions too, as we shall see below.

Outer clamping means 35 and plucking and tearing grippers 38 are provided in a required position around the periphery of the retwister rings 28.

Twist-balancing grippers 33 and possible abutments 37 are envisaged in cooperation with the plucking and tearing grippers 38.

Next, comb means 34 and inner clamping means 36 are provided within the retwister means 29.

The inner clamping means 36 can be included in the coordinated action of the coupling means 31-32.

The abutment means 37 may be omitted if the grippers 33 perform an action which is radial or is comparable to a radial action.

As the device has been shown with diagrams adopted as examples to clarify the description, let us now see the procedure.

The yarns 20-21 are first positioned between the opposed retwister means 29 and within the coupling means 31-32, as is shown in FIGS. 2, and are subjected to the untwisting action 30 carried out by the retwister means 29 in cooperation with the retwister rings 28.

At the end of untwisting (FIG. 3) the twists in the tract of the yarns 20-21 contained within the periphery of the retwister rings 28 will be S twists of a required value, for instance, whereas the twists outside that tract will continue to be the original Z twists.

At the end of untwisting (FIG. 3) the coupling means 31-32 bring the integral body tracts 43 of the yarns 20-21 into contact with each other; these tracts 43 will constitute in the splice 22 the tract of splice 23 having integral yarns 20-21 and are contained between the coupling means 31-32 at the end of the untwisting step.

The yarns 20-21 are engaged, substantially at about the end of untwisting, by the outer clamping means 35, which prevent transfer of negative twists to the tract of yarn 20-21 which is not to be torn.

The yarns 20-21 are gripped near the periphery of the retwister rings 28 at the part where they will continue to remain integral.

Still at about the end of untwisting (FIG. 4), the yarns 20-21 are clamped in the tract 43 or at the end of the tract 43 so that the negative twists are retained.

This clamping action can take place either through combined action of the coupling means 31-32 or through the action of appropriate inner clamping means 36.

The delimitation of the tracts 43 coincides then with a reciprocal thrust action exerted by the coupling means 31-32 or by the inner clamping means 36 respectively on the yarns 20-21.

Thus, when the untwisting has taken place, the negative twists imparted cannot move in the tracts 43 nor in the tracts which stretch from 43 towards the periphery of the retwister rings 28 and towards the yarns 20-21 which will remain integral.

Figure 4:
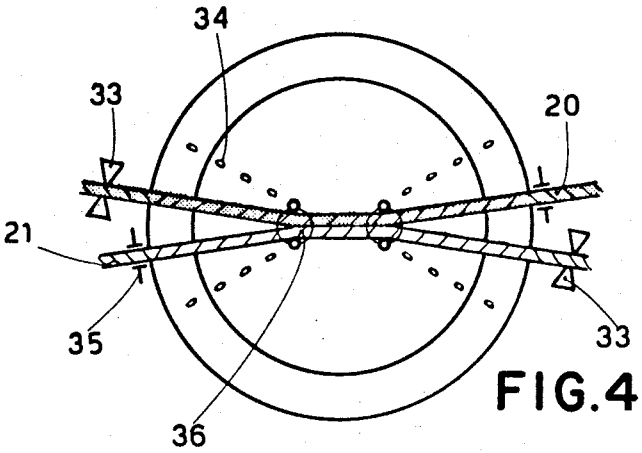
FIG. 4 shows the clamping of the yarns.
Figure 6:
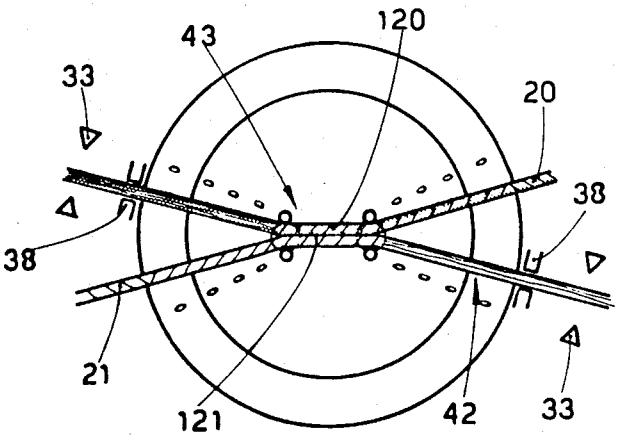
FIG. 6 shows the clamping performed to obtain remaining tails.

The tail ends 420-421 are clamped, at a moment which can be determined as required at about the end of the untwisting, by twist-balancing grippers 33 positioned at a required distance from the periphery of the retwister rings 28; such distance can be regulated as necessary (FIG. 4).

The moment at which the grippers 33 are closed is such as to balance the S twists contained at the end of untwisting in the tract stretching from the inner clamping point determined by 31-32 or by 36 towards the periphery of the retwister rings 28 against the Z twists contained in the tract stretching from the periphery of the retwister rings 28 to the grippers 33.

Figure 5:
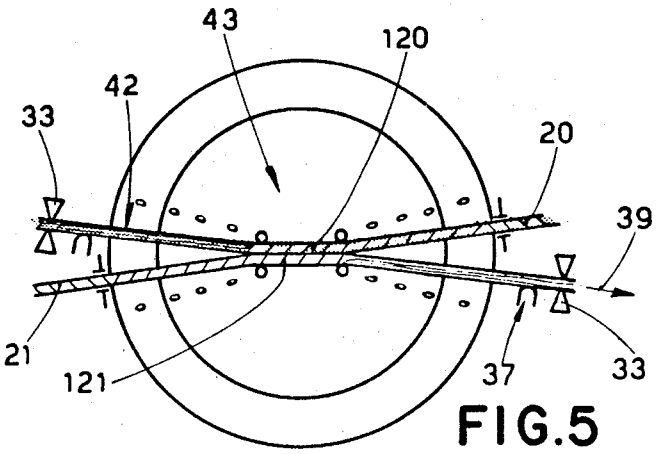
FIG. 5 shows the fibres made parallel in the tail ends.

When the grippers 33 have been actuated, the retwister means 29 and retwister rings 28 are opened slightly, and the negative twists contained in the tail ends 420-421 in the tract stretching from the inner clamping point determined by 31-32 or by 36 towards the periphery of the retwister rings 28 are eliminated together with the positive twists present outside the rings 28 and between the rings 28 and the grippers 33 (FIG. 5).

So as to remove any hysteresis in the fibres, the grippers 33 perform an action 39 of tensioning the tail ends, possibly with the help of abutments 37.

In this way tracts 42 of untwisted tail ends with substantially parallel fibres are obtained (FIG. 5).

The plucking and/or tearing grippers 38 then take action and act in cooperation with the periphery of the retwister rings 28, which clamp the untwisted parallel tail ends 42 at the required position.

The twist-balancing grippers 33 can now open and disengage the tail ends 42.

Next, the plucking and/or tearing grippers 38 exert an axial plucking and/or tearing action 40 on the untwisted parallel tail ends 42. This action 40 is carried out in cooperation with the clamping action performed by the inner clamping means 36 or by thier substitutes.

Figure 7:
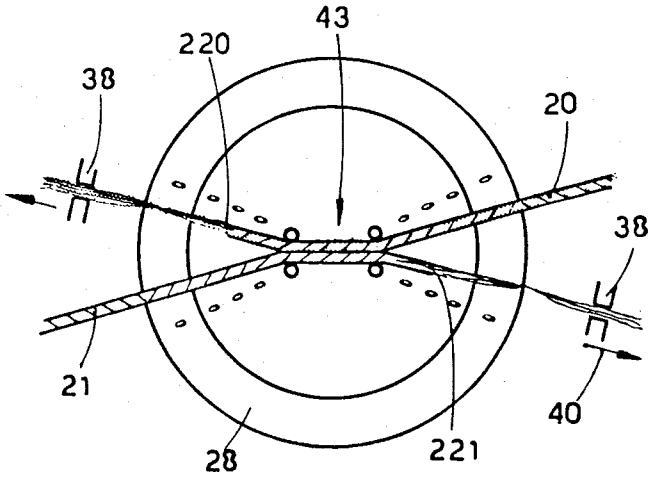
FIG. 7 shows the obtaining of tapered remaining tails.

As the action 40 is carried out on substantially parallel fibres, it is possible to obtain a progressive, resulting, remaining tail which starts at about the area controlled by the periphery of the rings 28 (FIG. 7).

The remaining tails 220-221 therefore comprise substantially parallel fibres and a tapered shape, the whole being controlled.

Figure 8:
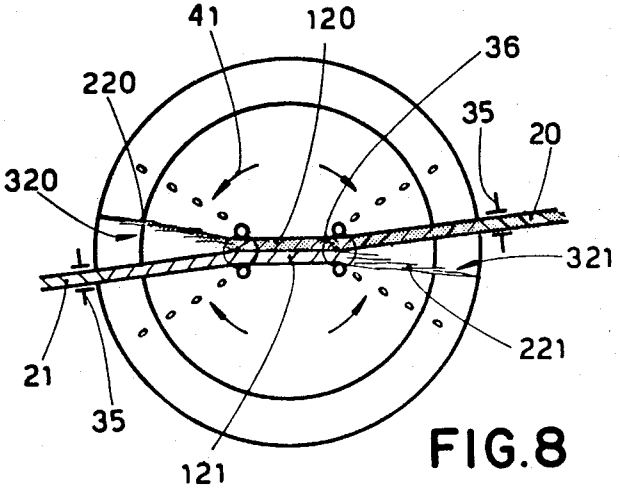
FIG. 8 shows the lateral control of the remaining tails.
Figure 9:
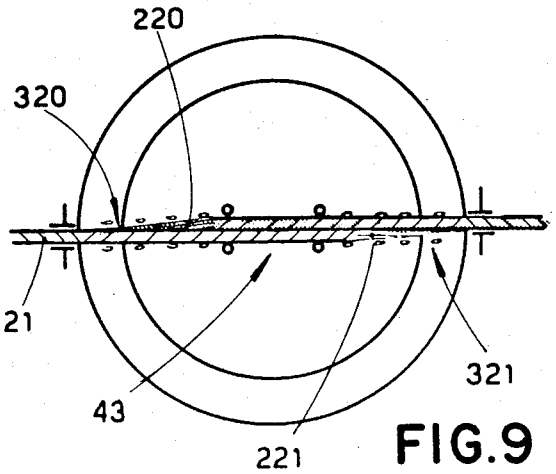
FIG. 9 shows the tapered remaining tails brought close to the yarns.

When the plucking and/or tearing action 40 has taken place, or in cooperation with that action 40, the comb means 34 act according to the movement 41 and are closed (FIG. 8), thus bringing the fibres of the remaining tails 220-221 into contact with the yarns 21-20 respectively (FIG. 9) by means of an action of controlled approach.

At about this time the retwister means 29 and retwister rings 28 come together again and one of each of them rotates in the opposite direction to the other of each of them according to the movement 130 so as to re-impart the required twists (FIG. 10).

The comb means 34 are retracted at about the beginning of such rotation.

A continuous control and feed of the yarns and fibres and of the action exerted on the yarns and fibres and of the transient effect as well as of the final result are therefore obtained with the proposed improvements.

INDEX

20—single yarn
120—tract of coupled yarn
220—reduced remaining tail
320—end part of remaining tail
420—tail end
21—single yarn
121—tract of coupled yarn
221—reduced remaining tail
321—end part of remaining tail
421—tail end
22—splice
23—middle tract of splice with integral yarns
24—yarn/remaining tail tract of splice
25—end tract of splice
26—section of yarn
27—section of splice
28—retwister rings
29—retwister means
30—untwisting rotation
130—retwisting rotation
31—coupling means
32—coupling means
33—twist-balancing grippers
34—comb means
35—outer clamping means
36—inner clamping means
37—abutment
38—plucking and/or tearing grippers
39—tensioning of tail ends
40—plucking and/or tearing
41—closure of comb means
42—untwisted tail ends made parallel
43—integral body.

We claim:

1. In a method of splicing yarns by coupling two single untwisted yarns together and thereafter reconstituting the twists using a machine having retwister rings, the improvement comprising untwisting a part of the twisted yarns until twists of a sign opposite to the sign of the original twists have been imparted, causing the parts with opposite twists in the coupled yarns to be made substantially parallel, coupling the part with the opposite twist of one yarn with the part with the opposite twist of the other yarn, applying a substantial axial plucking and/or tearing to the substantially parallel parts to obtain reduced tails of yarns, the taper of the remaining reduced tails reaching the neighborhood of the retwister rings, controlling the resulting remaining tails and positioning same beside said yarns before action to impart retwisting is begun and retwisting the coupled part until a desired twist has been imparted.

2. The method of claim 1 wherein said parts in said coupled yarns are made substantially parallel by substantially balancing the negative and positive twists obtained in the neighborhood of the periphery of said retwister rings.

3. The method of claim 2 wherein the balancing takes place after means for untwisting a part of the twisted yarns has been slackened off at least partially.

4. The method of claim 1 wherein said parts in the coupled yarns are made substantially parallel by passing through twist-balancing grippers and inner clamping means located respectively outside and inside the peripheral circumference of said retwister rings.

5. The method of claim 2 wherein said parts in the coupled yarns are made substantially prallel by passing through twist-balancing grippers and inner clamping means located respectively outside and inside the peripheral circumference of said retwister rings.

6. The method of claim 4 comprising gripping said coupled yarns with said twist-balancing grippers for said yarns to be plucked and/or torn before slackening off said untwisting means.

7. The method of claim 1 further comprising undertaking axial tensioning of said yarns after they have been made substantially parallel to eliminate any hysteresis in the fibers.

8. The method of claim 2 further comprising undertaking axial tensioning of said yarns after they have been made substantially parallel to eliminate any hysteresis in the fibers.

9. The method of claim 3 further comprising undertaking axial tensioning of said yarns after they have been made substantially parallel to eliminate any hysteresis in the fibers.

10. The method of claim 1 wherein said reduced remaining tails are obtained after said parts have been made substantially parallel by causing plucking and/or tearing gripprs to act on said substantially parallel parts along the periphery of said retwister rings.

11. The method of claim 4 wherein said reduced remaining tails are obtained after said parts have been made substantially parallel by causing plucking and/or tearing grippers to act on said substantially parallel fibers along the periphery of said retwister rings.

12. The method of claim 11 wherein said plucking and/or tearing grippers grip untwisted substantially parallel tail ends before said tail ends are released by said twist-balancing grippers and said plucking and/or tearing grippers, after release of the tail ends, act at least momentarily on the tail ends in a direction substantially along the axis of the tail ends and in cooperation with said inner clamping means.

13. The method of claim 1 further comprising pushing the reduced remaining tails alongside and against the yarns before said retwister means have been brought together and before retwisting has been imparted.

14. The method of claim 2 further comprising pushing the reduced remaining tails alongside and against the yarns before said retwister means have been brought together and before retwisting has been imparted.

15. The method of claim 3 further comprising pushing the reduced remaining tails alongside and against the yarns before said retwister means have been brought together and before retwisting has been imparted.

16. The method of claim 1 wherein the approach and pressure of the remaining tails against the yarns are obtained by using comb means in a controlled manner.

17. The method of claim 2 wherein the approach and pressure of the remaining tails against the yarns are obtained by using comb means in a controlled manner.

18. The method of claim 3 wherein the approach and pressure of the remaining tails against the yarns are obtained by using comb means in a controlled manner.

19. The method of claim 1 wherein said yarns are textile yarns.

20. A yarn containing a splice made in accordance with the method of claim 1.

21. The method of claim 1 wherein each of said yarns, at the end of the untwisting, includes a tract having an advantageously equal desired length, said tracts being side-by-side and located in the center of the untwisting means.

* * * * *